United States Patent [19]

Kumagai

[11] Patent Number: 5,062,243

[45] Date of Patent: Nov. 5, 1991

[54] OPENABLE ROOF

[75] Inventor: Takenori Kumagai, Tokyo, Japan

[73] Assignee: Shimizu Construction Co., Ltd., Tokyo, Japan

[21] Appl. No.: 440,928

[22] Filed: Nov. 24, 1989

[30] Foreign Application Priority Data

Nov. 24, 1988 [JP] Japan ..... 63-296448

[51] Int. Cl.[5] ..... E04B 1/346

[52] U.S. Cl. ..... 52/66; 52/82

[58] Field of Search ..... 52/64, 66, 55, 65, 82

[56] References Cited

U.S. PATENT DOCUMENTS

| | | | |
|---|---|---|---|
| 3,815,299 | 6/1974 | Sorensen et al. | 52/66 |
| 4,587,775 | 5/1986 | Lewis et al. | 52/66 |
| 4,676,033 | 6/1987 | Allen et al. | 52/6 |
| 4,682,449 | 7/1987 | Berger | 52/66 |
| 4,706,419 | 11/1987 | Adachi et al. | 52/65 |
| 4,727,698 | 3/1988 | Kida et al. | 52/66 |
| 4,738,057 | 4/1988 | Logan | 52/6 |
| 4,751,800 | 6/1988 | Kida et al. | 52/66 |
| 4,783,861 | 11/1988 | Leurent | 4/498 |
| 4,942,698 | 7/1990 | Kumagai | 52/6 |

FOREIGN PATENT DOCUMENTS

| | | |
|---|---|---|
| 772349 | 11/1967 | Canada . |
| 57-108355 | 7/1982 | Japan . |
| 61-162648 | 7/1986 | Japan . |
| 61-183910 | 2/1988 | Japan . |
| 63-181829 | 7/1988 | Japan . |
| WO86/06123 | 4/1985 | PCT Int'l Appl. . |
| 354256 | 8/1931 | United Kingdom . |
| 2199859A | 7/1988 | United Kingdom . |

OTHER PUBLICATIONS

Engineering Digest "The Sky Dome Retractable Roof System", published Jun. 1989.

Popular Science, Oct. 1958, p. 131.

*Primary Examiner*—Richard E. Chilcot, Jr.

*Assistant Examiner*—Creighton Smith

*Attorney, Agent, or Firm*—Varndell Legal Group

[57] ABSTRACT

In an openable roof capable of opening and closing a central space having a certain point, a stationary roof section is arranged in spaced relation to the certain point of the central space. The stationary roof section has an inner periphery which defines the central space. A movable roof section is arranged on the stationary roof section and is radially movable relatively thereto toward and away from the certain point of the central space. The movable roof section is divided into a plurality of movable roof units having their respective apexes which are substantially identical in central angle with each other. In a closed position where the central space is closed by the movable roof section, the apexes of the respective movable roof units are abutted against each other and the movable roof units cooperate with each other to close the central space. In an open position where the central space is open, the movable roof units are spaced from each other and are spaced from the certain point of the central space to open the latter. A drive unit is provided for drivingly moving the movable roof units between the open and closed positions.

15 Claims, 8 Drawing Sheets

OPENABLE ROOF

BACKGROUND OF THE INVENTION

The present invention relates to an openable roof capable of opening and closing a central portion thereof. The openable roof is typically used in a temporary structure for an event site or the like, though the applicational field is not limited to them.

Applicants of this invention have already filed a patent application relating to a roof capable of being opened and closed. The prior patent application is related to an openable roof for creating a so-called closed space when the top is closed by a movable roof section and creating an open space when the top is open.

FIGS. 13 through 15 of the attached drawings show an example of the openable roof which is disclosed in Japanese Patent Application No. Sho 61-81858 entitled "Movable Roof".

As shown in FIGS. 13 and 14, the movable roof or the openable roof 1 comprises a movable roof section which is composed of a plurality of roof units 2 formed into a sectorial shape. The roof units 2 are angularly movable about a center of rotation of the sectorial shape, whereby the movable roof section can open and close the roof building subject or a site L. The roof units 2 jointly use the common center of rotation. As shown in FIG. 15, a first support leg 3 and a second support leg 4 supporting each roof unit 2 are arranged respectively adjacent an arc of the sectorial shape forming the roof unit 2 and adjacent the center of rotation. The first and second legs 3 and 4 are provided respectively with slide mechanisms which are movable respectively along arcuate tracks 5 and 6.

An upper space above seats 8 is closed by a stationary roof section 7. In addition, although illustration is omitted, the first support leg 3 has its lower end which is provided with a drive device. By the drive device, wheels engaged with the track 5 travel along the same.

According to the openable roof 1, it is possible to angularly move the roof units 2 about the center of rotation that is the center of the sectorial shape. For instance, as illustrated in FIG. 14, in case where the openable roof 1 comprises four roof units 2, these four roof units 2 can be arranged in adjacent relation to each other to uniformly close or cover the upper portion of the roof building subject L. On the other hand, the adjacent four roof units 2 can be spaced two by two away from each other toward the stationary roof section 7, thereby opening the upper portion of the roof building subject L.

By the way, the openable roof 1 has such superior advantages that the movable roof section can be built and withdrawn with respect to the roof building subject L optionally and easily, whereby it is possible to freely cope with the weather and so on. However, the openable roof 1 has the following drawback.

That is, particularly, in the circular or sectorial roof, in case where the movable roof section is divided into a plurality of sectorial roof units which are angularly movable about the center of rotation to open and close the roof building subject L, a post 9 is required to be provided at the center of rotation, that is, at the center of the roof building subject L. The post 9 is an obstacle to effective utilization of the vast roof building subject L.

SUMMARY OF THE INVENTION

It is an object of the invention to provide an openable roof which has a superior function of forming a closed space and an open space, which can completely open the space in an open position, and in which it is unnecessary to arrange a post o the like at a roof building subject.

According to the invention, there is provided an openable roof capable of opening and closing a central space having a certain point, the openable roof comprising;

a stationary roof section arranged in spaced relation to the certain point of the central space by a predetermined distance, the stationary roof section having an inner periphery which defines the central space;

a movable roof section arranged on the stationary roof section and radially movable relatively thereto toward and away from the certain point of the central space between an open position where the central space is open and a closed position where the central space is closed, the movable roof section being divided into a plurality of movable roof units having their respective apexes which are substantially identical in central angle with each other, wherein, in the closed position, the apexes of the respective movable roof units are abutted against each other and the movable roof units cooperate with each other to close the central space, and wherein, in the open position, the movable roof units are spaced from each other and are spaced from the certain point of the central space to open the latter; and drive means for drivingly moving the movable roof units between the open and closed positions.

With the arrangement, the following superior advantages are obtained. That is, the movable roof units are moved toward and away from the certain point of the central space to open and close the latter, whereby it is possible to secure formation of the completely open space having no obstacles such as a post or the like at the point of the central space. Thus, the open space can effectively be utilized. Further, the drive means for the movable roof section can be made simple in construction, and the post or the like can be dispensed with. Thus, it is possible to contribute a reduction of the execution cost of the openable roof.

Preferably, the drive means comprises wire-like fastening means for connecting the apexes of the respective roof units to each other in the form of a ring to simultaneously move the movable roof units between the open and closed positions, and winding means mounted on at least one of the stationary roof section and the movable roof section for winding and unwinding the wire-like fastening means to move the movable roof units between the open and closed positions.

In this case, the wire-like fastening means can easily and quickly wound and unwound to simultaneously move the movable roof units between the open and closed positions, whereby it is possible to cope with a change in the weather and the like.

BRIEF DESCRIPTION OF THE DRAWINGS

FIG. 9(*a*) is a view similar to FIG. 8(*a*), but showing the movable roof units which move toward the fully closed position;

FIG. 9(*b*) is an enlarged cross-sectional view taken along the line IX*b* —IX*b* inn FIG. 9(*a*);

FIG. 10(*b*) is an enlarged cross-sectional view taken along the line Xb—Xb in FIG. 10(*a*);

DETAILED DESCRIPTION

Figure 1A:
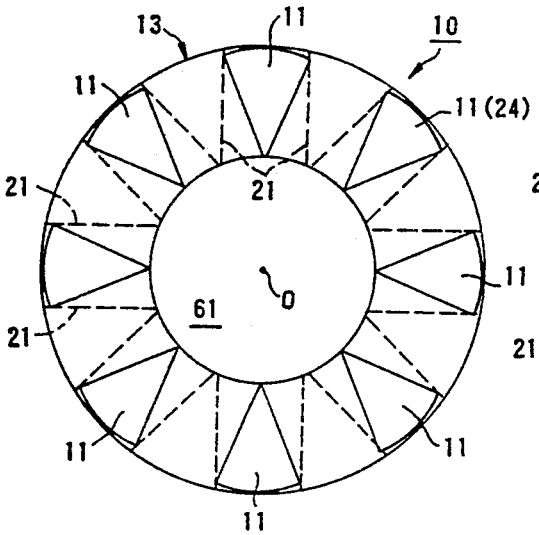
FIGS. 1(*a*) through 1(*d*) are somewhat diagrammatic top plan views showing a manner in which a plurality of movable sectorial roof units of an openable roof according to an embodiment of the invention from a fully open position to a closed position.
Figure 1B:
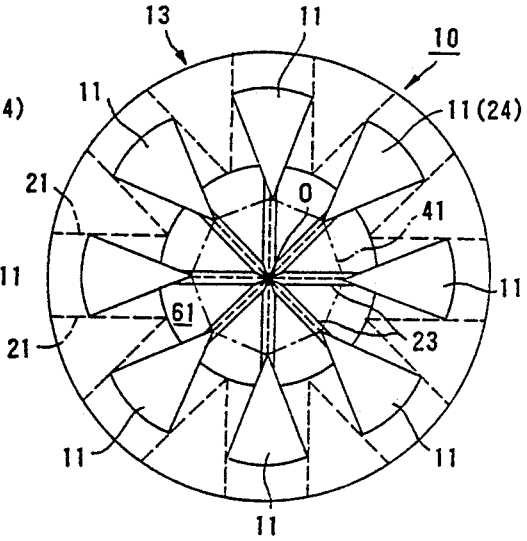
Figure 1C:
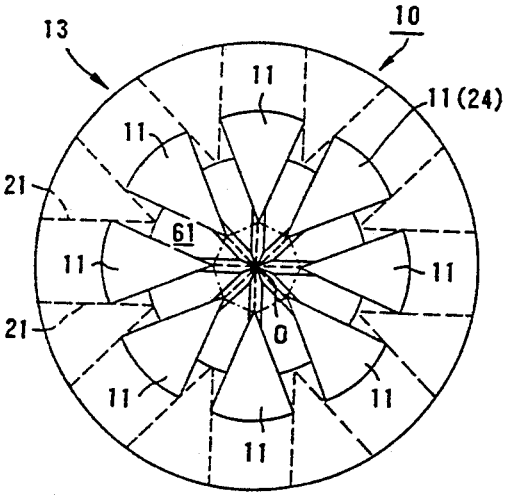
Figure 1D:
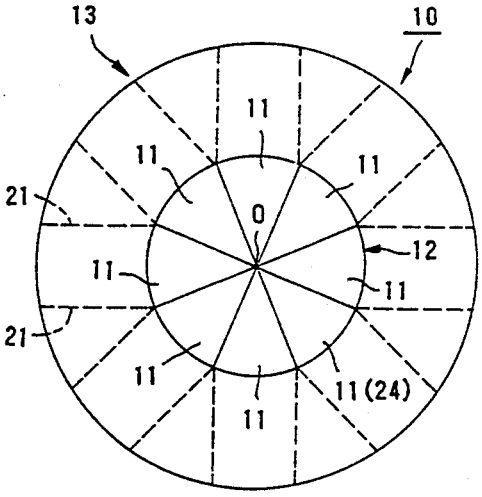
Figure 2A:
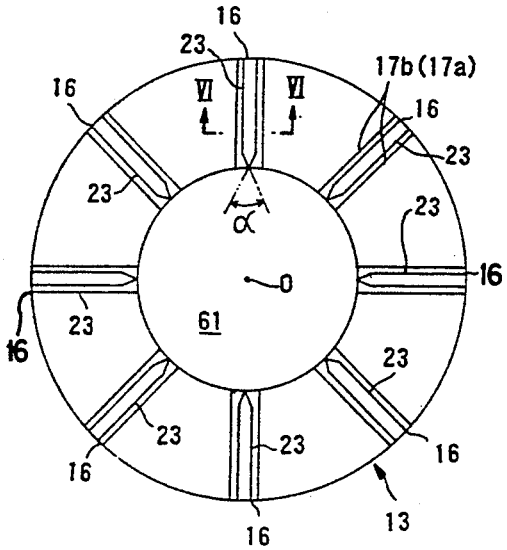
FIGS. 2(*a*) through 2(*d*) are somewhat diagrammatic bottom views showing movement, from the fully open position to the fully closed position, of a plurality of movable roofstructural supports of the respective movable roof units illustrated in FIGS. 1(*a*) through 1(*d*)
Figure 2B:
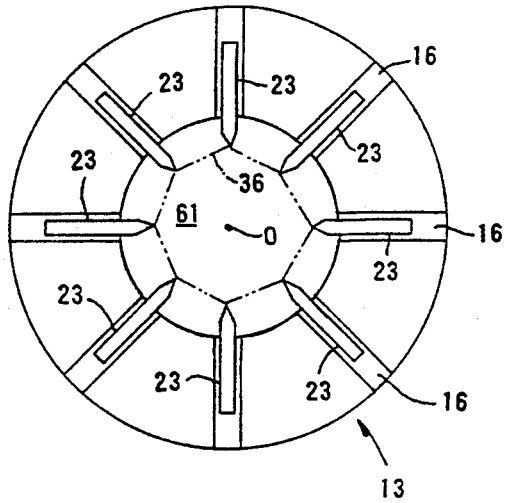
Figure 2C:
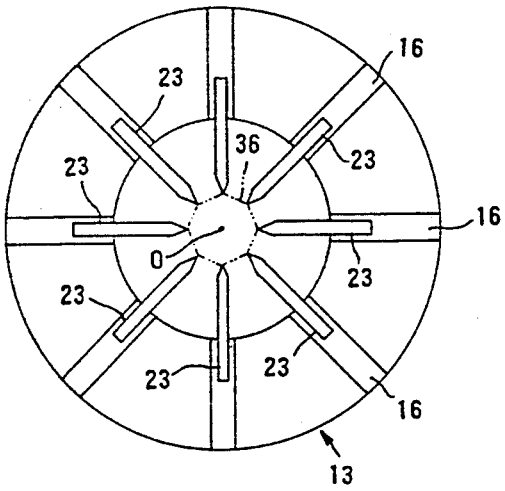
Figure 2D:
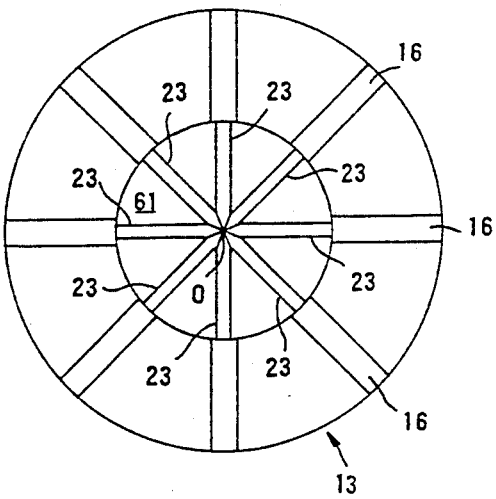

Referring to FIGS. 1(*a*) through 1(*d*) and FIGS. 2(*a*) through 2(*d*), there is shown a manner in which a movable roof section 12 (refer to FIG. 1(*d*)) of an openable roof 10 according to an embodiment of the invention moves from a fully open position illustrated in FIGS. 1(*a*) and 2(*a*) toward a fully closed position shown in FIGS. 1(*d*) and 2(*d*). Specifically, FIGS. 1(a) through 1(d) illustrate a manner in which a plurality of movable roof finishes 24 of respective movable sectorial roof units 11 forming the movable roof section 12 move from the fully open position to the fully closed position. FIG. 2(*a*) through 2(*d*) illustrate a plurality of movable roof-structural supports 23 of the respective movable sectorial roof units 11 from the fully open position to the fully closed position.

In FIG. 1(*d*), the openable roof 10 comprises the aforesaid movable roof section 12 and a stationary roof section 13. In the closed position, the movable roof section 12 is arranged at a circular central space 61 (refer to FIGS. 1(*a*) through 1(c)) of the openable roof 10 which is sectioned by a predetermined radius from a certain point or a circular center 0. The stationary roof section 13 is arranged in spaced relation to the circular center 0 by a radius of the central space 61. The stationary roof section 13 has its inner periphery which is circular to define &he circular central space 61.

In the illustrated embodiment, the openable roof 10 is in the form of a circle in plan as a whole. Specifically, the central space 61 is in the form of a circle in plan, and the stationary roof section 13 is in the form of an annulus in plan. It will be understood, however, that the invention is not limited to this specific openable roof, but is applicable to any openable roof in the form of a sector or a rectangle. Specifically, the central space 61, that is, the inner periphery of the stationary roof section 13 may be in the form of a sector or a rectangle in plan, and the stationary roof section 13 may itself be in the form of a sector or a rectangle in plan.

The movable roof section 12 is divided into the aforementioned plurality of, eight in the illustrated embodiment, movable sectorial roof units 11 which are the same in their central angle as each other. The openable roof 10 according to the embodiment is such that the movable roof units 11 are radially moved toward and away from the central point 0 to open and close the central space 61 as shown in FIGS. 1(*a*) through 1(*d*).

Figure 3:
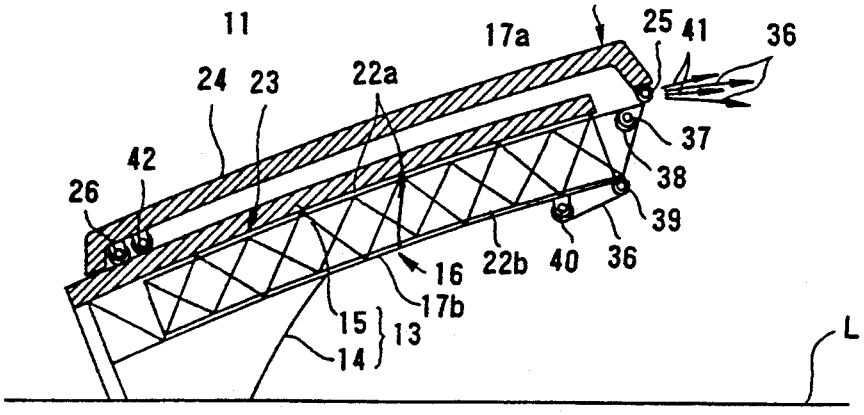
FIGS. 3 through 5 are enlarged schematic crosssectional, side elevational views showing movement, from the fully open position to the fully closed position, of the movable roof-structural support and a movable roof finish which form one of the movable roof units illustrated in FIGS. 1(*a*) through 1(*d*).
Figure 4:
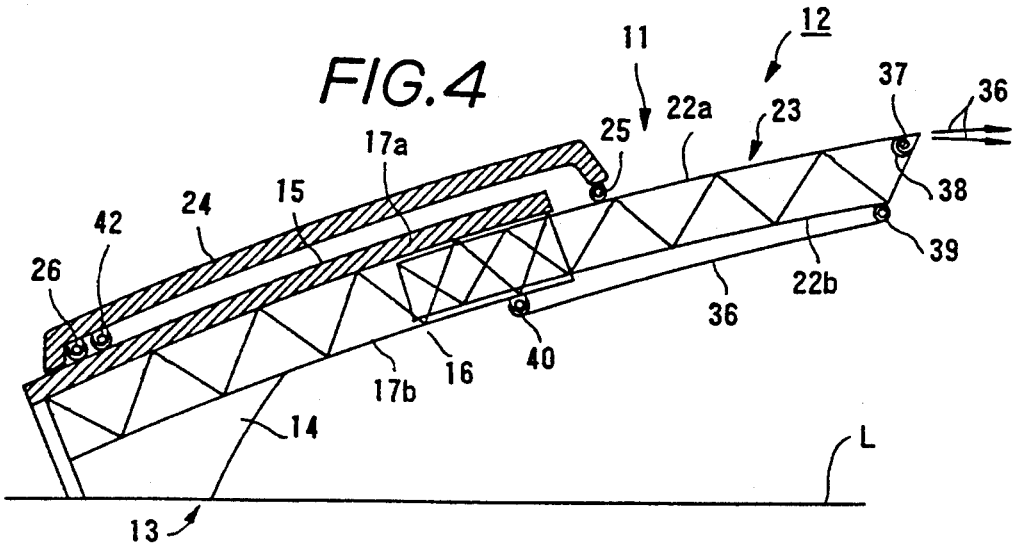
Figure 5:
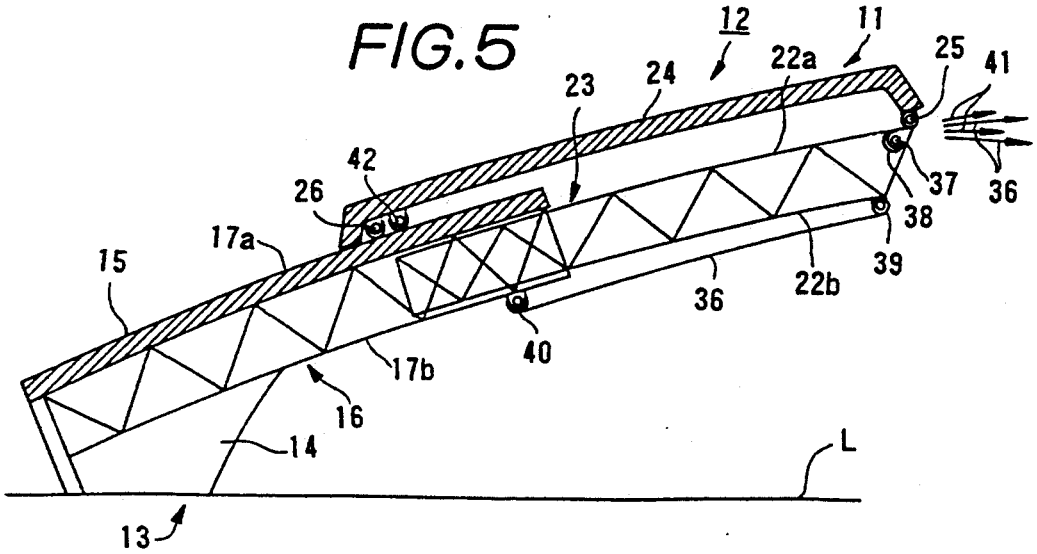

As illustrated in FIGS. 3 through 5, the stationary roof section 13 is formed with outer and inner inclined surfaces which gradually rise from an outer peripheral portion toward an inner peripheral portion of the stationary roof section 13. The inner and outer inclined surfaces are slightly convex upwardly. The stationary roof section 13 is composed of a plurality of stationary structural supports 14 formed by a stereoscopic truss construction and a plurality of stationary roof finishes 15 mounted respectively on the stationary structural supports 14.

Figure 6:
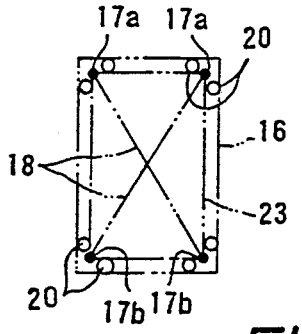
FIG. 6 is a somewhat diagrammatic cross-sectional view taken the line VI—VI in FIG. 2(*a*)

As illustrated in FIGS. 2(*a*) through 2(*d*), the stationary roof section 13 in the form of a ring or an annulus comprises a plurality of, or eight, stationary truss boxes 16 which extend radially and which are arranged in equidistantly and circumferentially spaced relation to each other. As shown in FIG. 6 which is a cross-sectional view taken along the line VI—VI in FIG. 2(*a*), each of the truss boxes 16 is hollow by surrounding of four main members, i.e., a pair of upper chord members 17*a* and 17*a* and a pair of lower chord members 17*b* and 17*b*, which all extend radially. In FIG. 6, the aforesaid movable roof-structural supports 23 form the movable sectorial roof units 11, respectively. A plurality of pairs of bearings 20 and 20 are arranged, at their predetermined positions, outside of the upper and lower chord members 17*a* and 17*b* forming each truss box 6 and a pair of tying members 18 and 18 such as lattices, braces or the like to slidably support the roof-structural support 23. Each pair of bearings 20 and 20 are spaced a predetermined distance from each other.

On the other hand, as shown in FIGS. 1(*a*) through 1(*d*), a plurality of pairs of rails 21 and 21 are laid on the roof finishes 15 of the stationary roof section 13 (refer to FIGS. 3 through 5). Each pair of rails 21 and 21 extend parallel to each other with the truss box 16 clamped centrally between them. The pairs of rails 21 and 21 and the truss boxes 16 serve as guides along which the movable sectorial roof units 11 move slidably.

As illustrated in FIG. 3, each of the movable sectorial roof units 11, which form the movable roof section 12, is composed of one of the aforesaid movable roof-structural supports 23 and one of the aforementioned plurality of movable roof supports or sectorial roof finishes 24 mounted respectively on the roof-structural supports 23. Similarly to each truss box 16, each of the roof-structural supports 23 has a pair of upper chord members 22*a* and 22*a* and a pair of lower chord members 22*b* and 22*b* to form a telescopic truss in the form of an elongated box. The same radius of curvature as the stationary structural supports 14 are given to the movable roof-structural supports 23. As shown in FIG. 4, each of the movable roof-structural supports 23 has its outer periphery which is supported by the pairs of bearings 20 and 20 (refer to FIG. 6) arranged inside of a corresponding one of the truss boxes 16, so that the movable roof-structural support 23 is longitudinally slidable along the truss box 16.

As shown in FIGS. 2(*a*) through 2(*d*), each of the movable roof-structural supports 23 is tapered or narrowed in lateral width at its forward end. The forward end of the movable roof-structural support 23 has an apex angle "$\alpha$" which is substantially 45°. As illustrated in FIGS. 3 through 5, each of the movable sectorial roof finishes 24, which are mounted respectively on the movable roof-structural supports 23, has a wheel 25 at the apex-angle portion of the sectorial roof finish 24 and a pair of wheels 26 (only one shown in FIGS. 3 through 5) at respective apex portions of a rearward end of the roof-structural support 23 which is formed into a sectorial arc. The pair of wheels 26 are in engagement respectively with the pair of rails 21 and 21 shown in FIGS. 1(*a*) through 1(*d*). That is, the movable roof finish 24 and the movable roof-structural support 23 are vertically spaced from each other by a gap or a clearance. The stationary roof finish 15 gets into the gap.

Figure 7A:
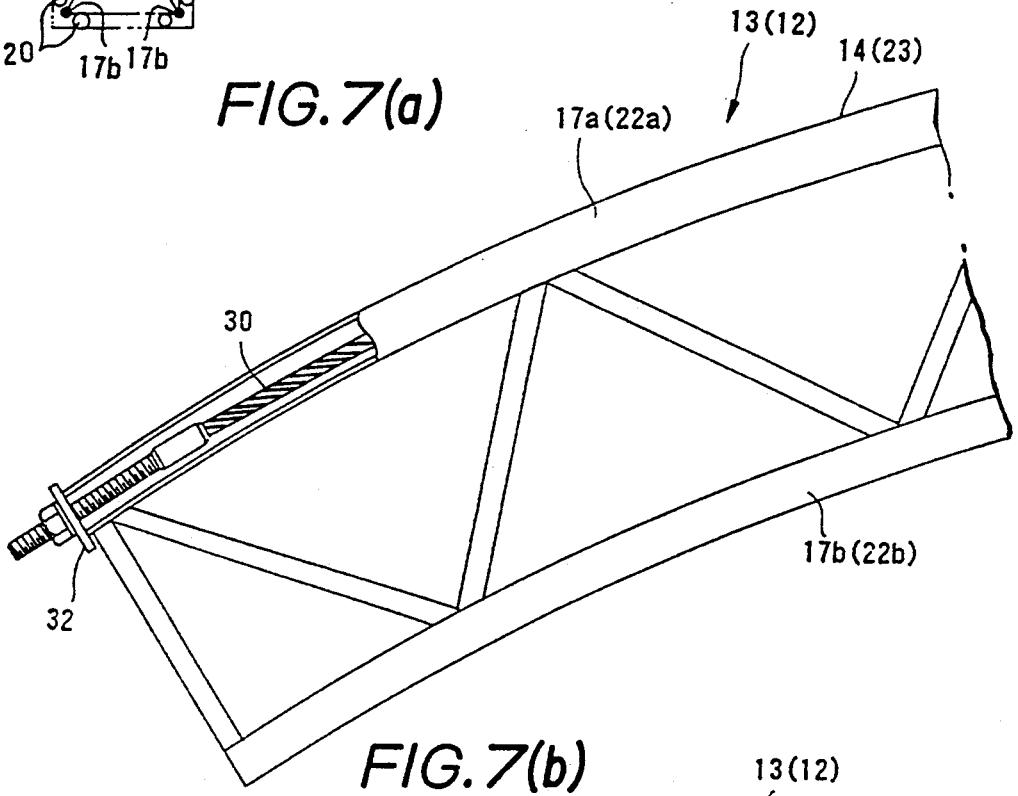
FIGS. 7(*a*) and 7(*b*) are partially broken-away, enlarged schematic side elevational views showing one of a plurality of stationary structural supports.
Figure 7B:
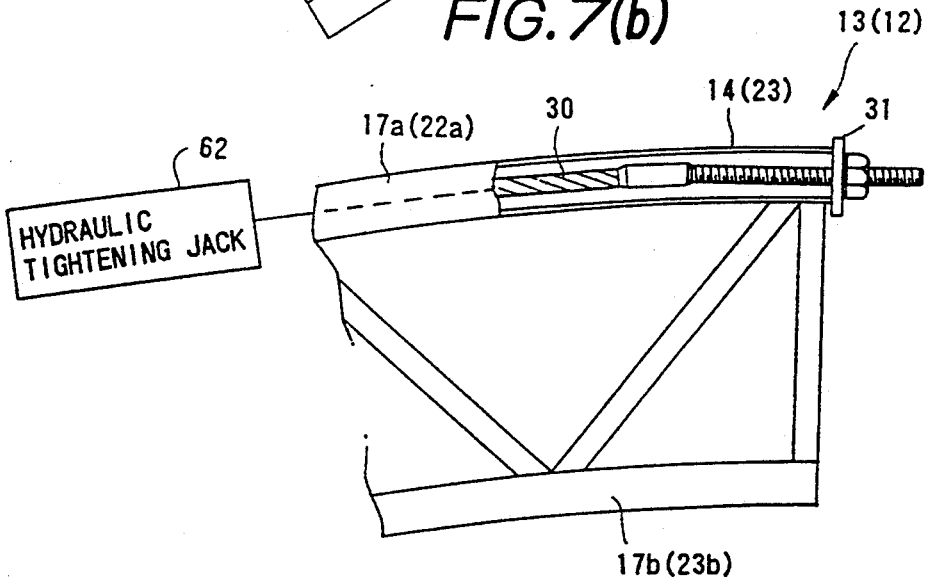

As shown in FIGS. 7(*a*) and 7(*b*), a PC steel wire 30 is incorporated in the pair of the upper chord members 17*a* and 17*a* of each of the stationary structural supports 15 which form the stationary roof section 13. Likewise, a PC steel wire 30 is incorporated in the pair of the upper chord members 22*a* and 22*a* of each of the movable roof-structural supports 233 which form the movable roof section 12. As will be understood from FIGS. 7(*a*) and 7(*b*), portions except for the radially extending eight truss boxes 16 of the stationary roof section 13, that is, portions of the stationary roof section 13 among the truss boxes 16 are formed also by telescopic trusses, and the PC steel wire 30 is incorporated in an upper chord member of each of the trusses. The PC steel wire 30 has one end or an upper end thereof which is fixed or fastened to the forward end of the structural support 14 or 23 by a fastener 31. The other end or a lower end of the PC steel wire 30 is fixed or fastened to the rearward end of the structural support 14 or 23 by a fastener 32 through a hydraulic tightening jack 62 for applying tightening force to the PC steel wire 30. Thus, pre-stress is given to the upper and lower chord members 22*a* and 22*b* of the respective roof-structural supports 23 forming the movable roof section 12, the upper and lower chord members 17*a* and 17*b* of the respective structural supports 14 forming the stationary roof section 13, and the portions of the stationary roof section 13 among the truss boxes 16.

As shown in FIGS. 2(*b*) and 2(*c*), opening and closing drive means comprises fastening means or a wire member 36 by which the tapered forward ends of the respective movable roof-structural supports 23 arranged in eight locations are connected to each other in the form of a ring. In this case, as illustrated in FIGS. 3 through 5, the forward ends of the upper chord members 22*a* of the respective roof-structural supports 23 are formed respectively with insertion bores 37 through which the wire member 36 extends. A plurality of pairs of pulleys 38 and 38 are provided respectively adjacent the insertion bores 37, with each insertion bore 37 located between the corresponding pair of pulleys 38 and 38, for holding the wire member 36 against disengagement from the insertion bores 37. The wire member 36, by which the forward ends of the respective movable roof-structural supports 23 are connected to each other in the form of a ring, has one end which is guided by a pulley 39 mounted to the lower chord member 22*b* of one of the movable roof-structural supports 23. The wire member 36 extends toward the truss box 16 associated with the movable roof-structural support 23, along the lower chord member 22*b*, and is wound around a winder 40 which is mounted to the truss box 16. The other end of the wire member 36 is fixed to the movable roof-structural support 23 or the truss box 16.

Likewise, as shown in FIGS. 1(*b*) and 1(*c*), the aforesaid opening and closing drive means further comprises fastening means or a wire member 41 by which tapered or narrowed forward ends the respective movable roof finishes 24 provided at eight locations ar connected to each other in the form of a ring. The wire member 41 has one end thereof which extends from the forward end of one of the movable roof finishes 24 to the rearward portion of the roof finish 24 through an insertion bore and a pulley (both not shown), similarly to the wire member 36 for the movable roof-structural supports 23. As shown in FIGS. 3 through 5, the one end of the wire member 41 is wound about a winder 42 which is mounted to an inner surface of the roof finish 24. The other end of the wire member 41 is fixedly connected to the same roof finish 24.

In connection with the above, the construction of the movable roof units 11, that is, the construction of the the movable roof-structural supports 23 is not limited to the telescopic truss beams into which pre-stress is introduced. That is, if the movable roof units 11 are not so long in their longitudinal length, the movable roof units 11 may be formed by a general truss construction into which no pre-stress is introduced, or may be formed by a lamella construction.

Figure 8A:
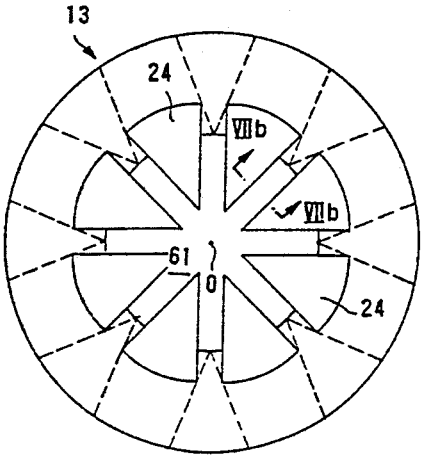
FIG. 8(*a*) is a top plan view of the openable roof illustrated in (*a*) through 1(*d*)
Figure 8B:
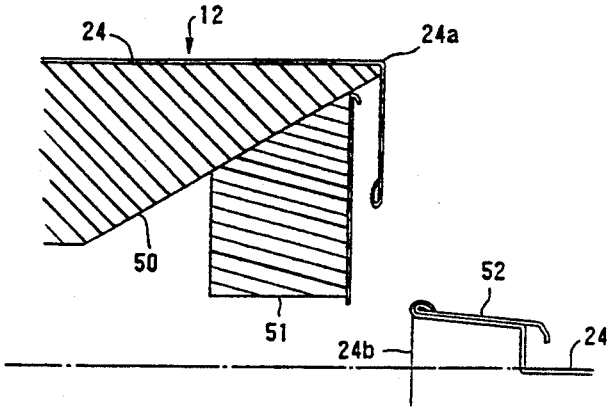

FIGS. 8(*a*) through 10(*b*) show a construction of a starling section for the movable roof section 12 of the openable roof 10 according to the embodiment of the invention. The starling section is provided to prevent water from entering the central space 61 when the movable roof section 12 is in the closed position.

Figure 11:
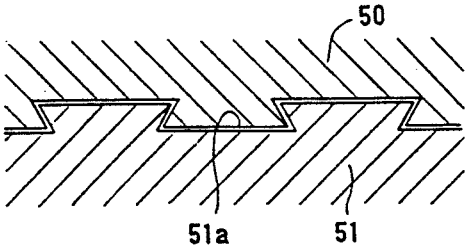
FIG. 11 is a cross-sectional view taken along the line XI—XI in 10(*b*)

FIG. 8(*b*) is a cross-sectional view along the line VIIIb—VIIIb in FIG. 8(*a*). In FIG. 8(*b*), each of the sectorial roof finishes 24 constituting the movable roof section 12 is formed such that both sides of the movable sectorial roof finish 24, which extend radially, stand on different levels. Accordingly, as shown in FIG. 8(*b*), one of both sides of one of the adjacent movable sectorial roof finishes 24 and 24, and one of both sides of the other movable sectorial roof finish 24, which are abutted against each other, stand on different levels. Of the sides standing on different levels, the higher side is formed with a tapered portion 50 in its inner surface such that the tapered portion 50 tapers off toward a side edge 24*a* of the roof finish 24. Further, an engaging member 51 is mounted on the tapered portion 50 so as to be slidable therealong. As shown in FIG. 11, the engaging member 51 is formed at its inclined upper face with a dovetail joint 51*a* which is dovetail-joined with that of the tapered portion 50.

Figure 9A:
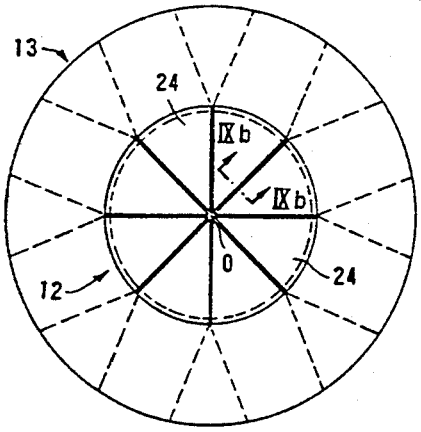
FIG. 9(*b*) is an enlarged cross-sectional view taken along the line VIII*b*—VIII*b* in FIG. 8(*a*), showing a starling section.
Figure 9B:
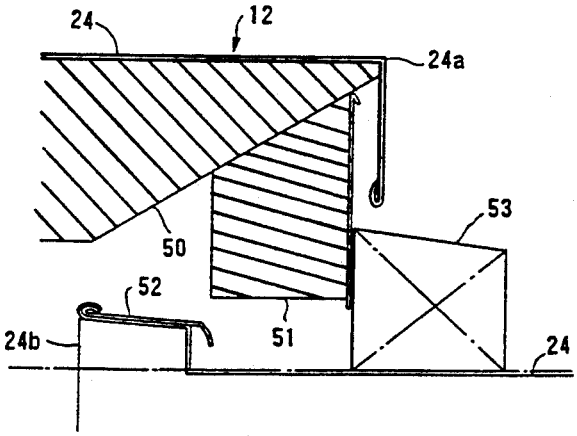

Referring again to FIGS. 8(*b*), 9(*b*) and 10(*b*), a first projection 52 slightly rising upwardly is formed on a side edge 24*b* of the adjacent roof finish 24, which is located at the low level. As shown in FIGS. 9(*b*) and 10(*b*), a second projection 53 is formed at a location on the roof finish 24, which is positioned slightly inwardly from the first projection 52. The second projection 53 has its projecting height which is higher than that of the first projection 52. The first and second projections 52 and 53 are formed parallel to each other and are spaced from each other by a distance which is equal to or slightly larger than the width of the movable engaging member 51.

The operation of the openable roof constructed as above will next be described.

Under the condition shown in FIG. 1(*a*), the movable sectorial roof units 11 are spread radially and are overlapped with the ring-like or annular stationary roof unit 13. Thus, the sectorial roof units 11 are spaced from each other circumferentially and equidistantly. That is, as shown in FIGS. 2(*a*) and 3, the movable roof-structural supports 23 are accommodated respectively in the truss boxes 16 of the respective stationary structural supports 14. The movable sectorial roof finishes 24 supported respectively by the movable roof-structural supports 23 are overlapped with the upper surfaces of the respective stationary roof finishes 15. Under this condition, the central space 61 of the circular openable roof 10 is open. Thus, the open central space 61 is given to the subject site such as an event site and the like on which the openable roof 10 is erected, so that people can sufficiently enjoy sunlight, fresh air and so on. In this connection, under this condition or stage, no tightening force is given to the PC steel wires 30 for both the stationary structural supports 14 and the movable roof-structural supports 23.

In order to close the central space 61 from this condition, as shown in FIGS. 2(*a*) through 2(*d*), the movable roof-structural supports 23 are first closed. That is, the winder 40 illustrated in FIGS. 3 through 5 is driven to wind the wire member 36 gently or slowly. As described previously, since the wire member 36 passes through the pulleys 38 and connects all the forward ends of the respective eight movable roof-structural supports 23 to each other in the form of a ring, winding of the wire member 36 reduces the ring diameter gradually. Accompanied with this, as shown in FIG. 4, the forward ends of the respective movable roof-structural supports 23 simultaneously approach each other toward the circular center 0 of the central space 61 while the movable roof-structural supports 23 slide respectively within the truss boxes 16. In a short time, the forward ends of the respective movable roof-structural supports 23 are all abutted against each other. In this manner, the movable roof-structural supports 23 are radially assembled together on the central space 61 of the openable roof 10 n the form of a dome. Under this condition, tightening force is given too the PC steel wires 30 by the hydraulic tightening jacks 62. Thus, pre-stress is introduced into the movable roof-structural supports 23.

Subsequently, as shown in FIGS. 1(*a*) through 1(*d*), the movable roof finishes 24 are moved toward the circular center 0 of the central space 61. That is, the winder 41 is driven slowly to wind the wire member 41. As mentioned previously, the wire member 41 passes through the pulleys (not shown) and connects all the forward ends of the respective eight movable roof finishes 24 to each other in the form of a ring, winding of the wire member 41 reduces the ring diameter gradually. Accompanied with this, as shown in FIG. 5, the forward ends of the respective movable roof finishes 24 simultaneously approach each other toward the circular center 0 of the central space 61. In a short time, as shown in FIG. 1(*d*), the forward ends of the respective movable roof finishes 24 are all abutted against each other. In this manner, the movable roof finishes 24 are radially assembled together on the central space 61 of the openable roof 10 in the form of a dome, and the central space 61 is closed by the movable roof finishes 24. Under this condition, tightening force is given to the PC steel wires 30 by the hydraulic tightening jacks 62. Thus, pre-stress is introduced into the movable roof finishes 24.

The operation of the starling section for the openable roof 10 accompanied with the closing operation of the movable roof finishes 24 will be described with reference to FIGS. 8(*a*) through 10 (*b*).

Figure 10A:
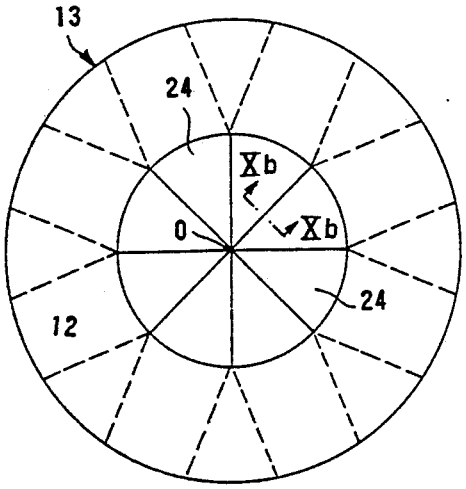
FIG. 10(*a*) is a view similar to FIG. 8(*a*), but showing the movable of units in the fully closed position.
Figure 10B:
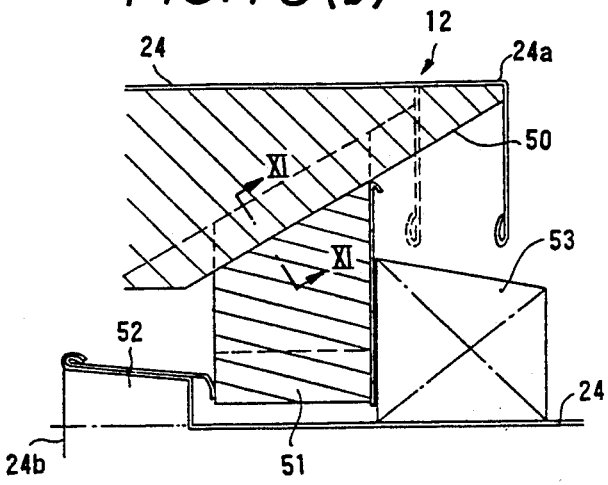

When the movable roof finishes 24 under the condition shown in FIGS. 8(*a*) and 8(*b*) approach each other toward the circular center 0 of the central space 61 as shown in FIGS. 9(*a*) and 9(*b*), the side edge 24*a* of one of the adjacent roof finishes 24 and 24, which is located at the high level, approaches the side edge 24*b* of the other roof finish 24, which is located at the low level. As shown in FIG. 9(*b*), the engaging member 51 of the one roof finish 24 moves beyond the first projection 52 on the other roof finish 24, and is abutted against and engaged with the second projection 53 on the other roof finish 24. When the movable roof finishes 24 approach each other from this condition as illustrated in FIGS. 10(*a*) and 10(*b*), the interaction between the tapered portion 50 and the engaging member 51 engaged with the second projection 53 causes the engaging member 51 to slide downwardly along the tapered portion 50. Thus, as shown in FIG. 10(*b*), the engaging member 51 is accommodated in a groove between the first and second projections 52 and 53. In this manner, the starling section is completed. Moreover, although the engaging member 51 is abutted against the first projection 52 at the opening operation of the roof finishes 24, the tapered portion 50 slides upwardly. Accordingly, the engaging member 51 is disengaged from the first projection 52, so that the opening operation of the movable roof finishes 24 is made possible.

In connection with above, if it is desired that the movable sectorial roof units 11 are moved from the open position toward the closed position, the above-described steps of procedure are done in reverse order.

According to the embodiment of the invention, there are provided the following superior advantages:

(1) Since pre-stress is given to the movable roof-structural supports 23 by the PC steel wires 30, it is possible to reduce deflection of the movable roof units 11. Further, the introduced pre-stress enables parts of the tension loads applied to the upper and lower chord members 22*a* and 22*b* of the respective movable roof-structural supports 23, to be born by the PC steel wires 30. Lightening of the roof units 11 can correspondingly be realized. By doing so, it is particularly possible to bring the movable roof units 11 to a long span construction. The above is also applicable to the stationary roof section 13.

(2) When the roof units 11 are moved between the open and closed positions toward and away from the circular center 0 of the central space 61, the wire members 36 and 41 passing through the forward ends of the respective movable roof-structural supports 23 and the respective movable roof finishes 24 of the roof units 11 are merely wound and unwound by the winders 40 and 42, respectively. Winding and unwinding of the wires 36 and 41 by the winders 40 and 42 cause the roof units 11 to be simultaneously moved toward and away from the circular center 0 of the central space 61. In this manner, troublesome or cumbersome operation can be dispensed with such as driving of each of the movable roof units 11. Thus, it is possible to do the opening and closing operation of the movable roof section 12 quickly, and it is possible to sufficiently cope with a sudden change in the weather and so on.

(3) In the construction of the starling section for the movable roof sectioon 12, the side edges 24*a* and 24*b* oof the respective adjacent movable roof finishes 24 and 24 stand in different levels from each other. Accordingly, it is possible to permit or allow slight divergence or gap between the side edges 24*a* and 24*b* due to the use of the movable roof section 12 for a long period of time. Further, under the closed condition between the side edges 24*a* and 24*b*, the engaging member 51 of one of the side edges 24*a* is engaged with the groove between the first and second projections 52 and 53 of the other side edge 24*b* by the action of the tapered portion 50. Thus, it is possible to always secure constant starling effects.

Figure 12:
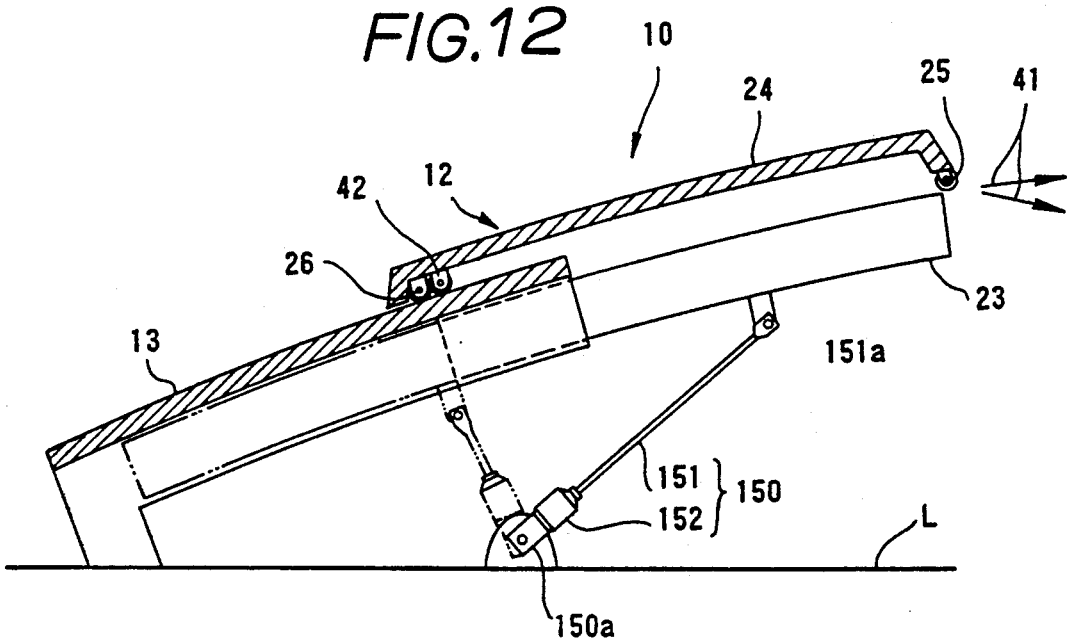
FIG. 12 is a cross-sectional view showing an openable roof according to another embodiment of the invention.
Figure 13:
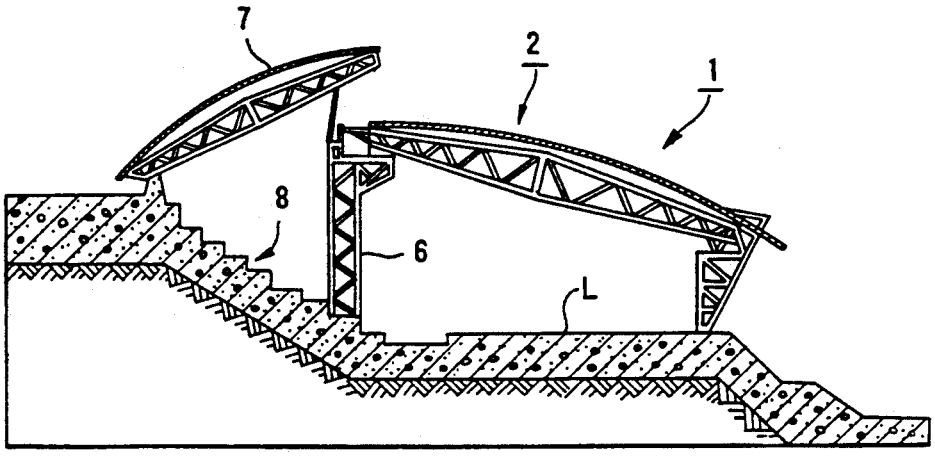
FIG.13 (PRIOR ART)
FIG. 13 is a cross-sectional, side elevational view showing the conventional openable roof.
Figure 14:
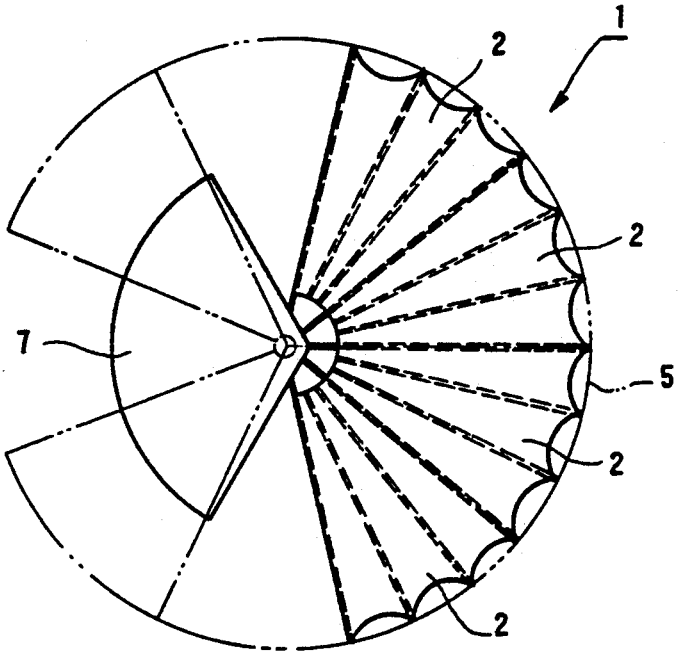
FIG. 14 is a top plan view of the openable roof illustrated in FIG. 13.
Figure 15:
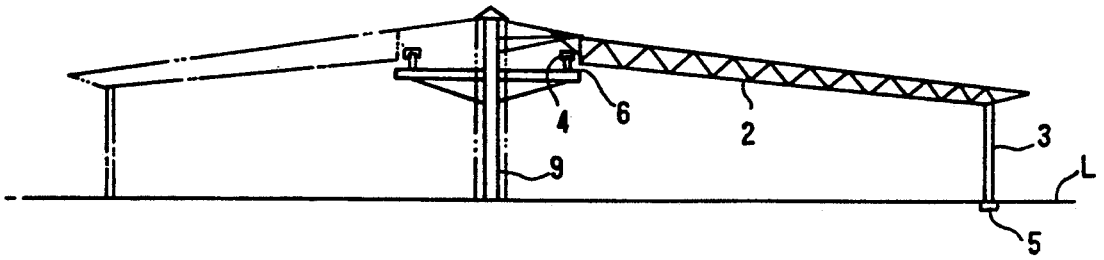
FIG.15 (PRIOR ART)
FIG. 15 a side elevational view showing a building construction of a movable-roof truss beam of the openable roof shown in FIGS. 13 and 14.

Referring to FIG. 12, there is shown an openable roof according to another embodiment of the invention. In FIG. 12, components and parts like or similar to those of the embodiment illustrated in FIGS. 1(*a*) through 11 are designated by the same reference numerals to avoid repetition.

The openable roof 10 according to the another embodiment utilizes hydraulic jacks 150 in substitution for the winders 40 illustrated in FIGS. 3 through 5, as opening and closing drive means for the movable roof section 12.

As shown in FIG. 12, each of the hydraulic jacks 150 has its base end 150*a* which is fixedly mounted on the roof building subject L so as to move angularly in a vertical plane. The hydraulic jack 150 has a rod 151 which extends and contracts with respect to a jack body 152 by hydraulic force. The rod 151 has its forward end 151*a* which is connected substantially to a center of the movable roof-structural support 23 so as to move angularly in the vertical plane. Extension and contraction of the rod 151 cause the movable roof-structural support 23 supported by the rod 151 to be moved between the open and closed positions.

Similarly to the movable roof finishes 24 of the aforesaid first embodiment, each of the movable roof finishes 24 is formed separately from the corresponding one of the movable roof-structural supports 23. Moreover, forward ends of the respective movable roof finishes 24 are connected to each other in the form of a ring by fastening means or a wire member 41 which forms the opening and closing drive means. The wire member 41 has one end thereof wound about a winder 42 which is fixedly mounted to an inner surface of the movable roof finish 24. The other end of the wire member 41 is fixedly connected to the same movable roof finish 24.

According to the another embodiment shown in FIG. 12, a part of the load of the movable roof-structural support 23 is born by the rod 151 of the hydraulic jack 150. Thus, it is possible to lengthen the span of the movable roof-structural support 23 without introduction of pre-stress into the movable roof-structural support 23.

Further, the wire member 41 may be dispensed with. That is, the movable roof finish 24 and the movable roofstructural support 23 may be united together such that they are simultaneously moved between the open and closed positions while the load of the movable roof finish 24 and the movable roof-structural support 23 is sufficiently supported by the hydraulic jack 150.

What is claimed is:

1. An openable roof capable of opening and closing a central space having a certain point, said openable roof comprising;

a stationary roof section arranged in spaced relation to said certain point of said central space by a predetermined distance, said stationary roof section having an inner periphery which defines said central space;

a movable roof section arranged on said stationary roof section and radially movable relatively thereto toward and away from said certain point of said central space between an open position where said central space is open and a closed position where said central space is closed, said movable roof section being divided into a plurality of movable roof units, each of said movable roof units including a radially movable roof-structural support movable relative to said stationary roof section and a radially movable roof finish movable relative to said movable roof-structural support, said movable roof finishes having their respective apexes which are substantially identical in central angle with each other, wherein, in said closed position, said apexes of said movable roof finishes abut against each other and said movable roof units cooperate with each other to close said central space, and wherein, in said open position, said movable roof finishes are spaced from each other and are spaced from said certain point of said central space to open the latter; and drive means for drivingly moving said movable roof units between said open and closed positions.

2. An openable roof according to claim 1, wherein said drive means comprises wire-like fastening means for connecting said apexes of the respective movable roof finishes to each other in the form of a ring to simultaneously move said movable roof finishes between said open and closed positions, and winding means mounted on at least one of said stationary roof section and said movable roof section for winding and unwinding said wirelike fastening means to move said movable roof finishes between said open and closed positions, and wherein winding of said wire-like fastening means causes said movable roof finishes to move to the closed position, and unwinding of said wire-like fastening means causes said movable roof finishes to move to the opened position.

3. An openable roof according to claim 1, wherein said drive means comprises hydraulic means mounted on a site and connected to said movable roof units for moving the latter between said open and closed positions.

4. An openable roof according to claim 1, wherein said movable roof-structural supports have their respective apexes which are substantially identical in central angle with each other, and in said closed position, said apexes of said movable roof-structural supports abut against each other and, in said open position, said movable roof-structural supports are spaced from each other and are spaced from said certain point of said central space to open the latter.

5. An openable roof according to claim 4, wherein said drive means includes a first wire-like fastening means for connecting said apexes of said movable roof finishes to each other to move the latter between said open and said closed positions, and a second wire-like fastening means for connecting said apexes of said movable roof-structural supports to each other to move the latter between said open and said closed positions.

6. An openable roof according to claim 4, wherein said drive means comprises first wire-like fastening means mounted on at least one of said movable roof finishes for connecting the apexes of the movable roof finishes to each other to move the latter between said open and closed positions, and second wire-like fastening means mounted on at least one of said movable roof-structural supports for connecting the apexes of the movable roof-structural supports too each other to move the latter between said open and closed positions.

7. An openable roof according to claim 6, wherein said stationary roof section comprises a plurality of roof finishes arranged respectively between said movable roof-structural supports and said movable roof finishes.

8. An openable roof according to claim 4, wherein said drive means comprises wire-like fastening means mounted on at least one of said movable roof finishes for connecting the apexes of the movable roof finishes to each other to move the latter between said open and closed positions, and hydraulic means mounted on a site and connected to said movable roof-structural supports for moving the latter between said open and closed positions.

9. An openable roof according to claim 4, wherein each of said movable roof-structural supports has its apex angle which is substantially 45° .

10. An openable roof according to claim 1, wherein said inner periphery of said stationary roof section is circular in shape in plan and defines said central space which is circular in plan, said certain point is a circular center of said central space, and said predetermined distance is a radius of said circular central space.

11. An openable roof according to claim 10, wherein said stationary roof section is annular in shape in plan.

12. An openable roof according to claim 1, wherein each of said movable roof units is sectorial in shape in plan.

13. An openable roof according to claim 1, including means for pre-stressing said stationary roof section, and means for pre-stressing said movable roof section.

14. An openable roof according to claim 1, including starling means arranged between each pair of adjacent movable roof units for preventing water from entering said central space when said movable roof section is in said closed position.

15. An openable roof according to claim 14, wherein each of said movable roof units has both sides, wherein, in said closed position, one of the both sides of the movable roof unit is abutted against one of the both sides of the adjacent movable roof unit to close said centrals pace, and wherein said starling means comprises a higher step provided on one side of each movable roof unit and a lower step provided on the other side of the movable roof unit, said higher step and said lower step being engaged with each other to prevent water from entering said central space.

* * * * *